United States Patent [19]

Glöckler et al.

[11] 4,311,123

[45] Jan. 19, 1982

[54] METHOD AND APPARATUS FOR CONTROLLING THE FUEL SUPPLY OF AN INTERNAL COMBUSTION ENGINE

[75] Inventors: Otto Glöckler, Renningen; Dieter Günther, Murr; Ulrich Steinbrenner, Stuttgart; Peter Schülzke, Hemmingen; Albrecht Sieber, Böblingen, all of Fed. Rep. of Germany

[73] Assignee: Robert Bosch GmbH, Stuttgart, Fed. Rep. of Germany

[21] Appl. No.: 966,704

[22] Filed: Dec. 5, 1978

[30] Foreign Application Priority Data

Jan. 17, 1978 [DE] Fed. Rep. of Germany ..... 2801790

[51] Int. Cl.[3] ..... F02D 5/02

[52] U.S. Cl. ..... 123/325; 123/493

[58] Field of Search ..... 123/32 EL, 32 EA, 97 B, 123/32 EE, 32 EH

[56] References Cited

U.S. PATENT DOCUMENTS

| | | | |
|---|---|---|---|
| 3,483,851 | 12/1969 | Reichardt | 123/32 EA |
| 3,727,591 | 4/1973 | Suda | 123/32 EL |
| 3,794,003 | 2/1974 | Reddy | 123/32 EA X |
| 3,809,028 | 5/1974 | Luchaco | 123/97 B X |
| 3,946,704 | 3/1976 | Monpetit | 123/493 X |
| 4,010,717 | 3/1977 | Taplin | 123/32 EH |
| 4,094,274 | 6/1978 | Harada et al. | 123/32 EL |
| 4,143,623 | 3/1979 | Norimatsu et al. | 123/32 EE |

*Primary Examiner*—Tony M. Argenbright
*Attorney, Agent, or Firm*—Edwin E. Greigg

[57] ABSTRACT

In order to prevent undesirable abrupt changes in engine torque when the fuel supply to the engine is shut off at the onset of engine braking, the invention provides the gradual decrease of the amount of fuel supplied to the engine beginning with the onset of engine braking and continuing until fuel has decreased to approximately 80 percent of the normal amount at which time the fuel is shut off entirely. When engine braking stops or when the operator indicates a demand for acceleration, the fuel supply is initiated at the level of approximately 80 percent of normal and is increased thereafter up to the normal amount according to a second selectable function of time.

19 Claims, 5 Drawing Figures

METHOD AND APPARATUS FOR CONTROLLING THE FUEL SUPPLY OF AN INTERNAL COMBUSTION ENGINE

FIELD OF THE INVENTION

The invention relates to the fuel control of an internal combustion engine during and after engine overrunning, i.e., engine braking, for example during deceleration or downhill operation. The method provides for a reduction of the fuel supply to the engine during engine braking according to a selectable function of time resulting ultimately in complete fuel shutoff. Similarly, after the condition of engine braking, the fuel is resupplied according to another selectable function of time. The apparatus for carrying out the method according to the invention includes an engine braking recognition circuit and a function generator for controlling the reduction and the readmission of fuel during and after the occurrence of engine braking.

BACKGROUND OF THE INVENTION

Known in the art are fuel metering systems which terminate the fuel supplied to the engine when the throttle valve is closed and when the engine speed lies above a certain limiting value. The known apparatus permits a deceleration of the vehicle by means of engine braking but has the inherent disadvantage that the sudden resupply of fuel at the termination of the engine braking period results in a distinct jolting of the vehicle when power is reapplied to the drive train. This jolt diminishes the driving comfort and may also be a detriment to safety. Furthermore, the abrupt shutoff and readmission of fuel results in abrupt torque changes in the drive train of the vehicle which tends to be destructive to the drive train components.

OBJECT AND SUMMARY OF THE INVENTION

It is thus a principal object of the present invention to provide a fuel supply system which recognizes the occurrence of engine braking and which changes the fuel supply in that condition in a gradual manner, providing gentle transitions to and from the engine braking status. It is a further object of the invention to provide for the transitional fuel supply in such a manner as to prevent abrupt changes in engine torque, thereby providing optimum driver comfort and safety.

These and other objects are attained according to the present invention by reducing the fuel supply at the occurrence of engine braking according to a selectable function of time and resupplying fuel at the termination of engine braking according to another selectable function of time. The apparatus for carrying out the invention includes a function generator which responds to an engine braking recognition circuit and which engages the fuel metering system of the engine in the appropriate manner.

It has been found particularly advantageous to change the period of time during which fuel is increased at the end of engine braking dependent on operational states of the engine. For example, the fuel supply is returned to normal magnitudes very rapidly if the driver indicates a desire for rapid acceleration by the appropriate throttle valve position or motion. It is a further feature of the invention to shut off the fuel supply to the engine entirely during engine braking when the magnitude of the fuel supply has diminished to approximately 80 to 90 percent of its normal value because, when the fuel supply drops below that value, the mixture cannot be reliably ignited, thereby creating the possibility of raw fuel being emitted through the exhaust system with the attendant deleterious effects on the exhaust gas composition.

The invention will be better understood as well as further objects and advantages thereof become more apparent from the ensuing detailed description of a preferred exemplary embodiment taken in conjunction with the drawing.

DESCRIPTION OF THE PREFERRED EMBODIMENT

Figure 1:
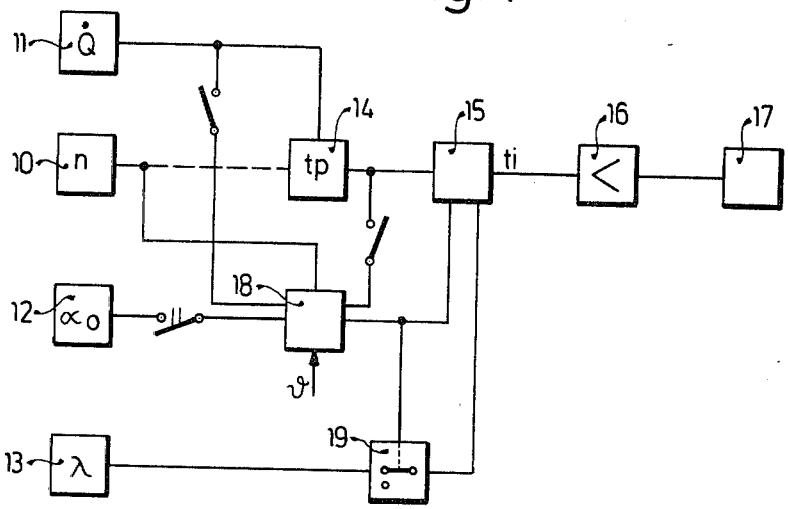
FIG. 1 is a schematic block diagram of a fuel injection system of an internal combustion engine including the elements according to the present invention.

Turning now to FIG. 1, there will be seen an overall schematic block diagram of a fuel injection system of an internal combustion engine. The system includes a number of engine transducers, i.e., a speed transducer (tachometer) 10, an air flow rate meter 11 located in the induction tube of the engine, a throttle flap position transducer 12 and an oxygen sensor (λ-sensor) 13 located in the exhaust system of the engine. Based on the air flow rate and the engine speed, a control multivibrator 14 generates a basic fuel injection control pulse $t_p$ which is corrected in a correction circuit 15 on the basis of a number of further operational states of the engine and is transformed into a corrected control pulse $t_i$. The control pulse $t_i$ is amplified in an amplifier 16 and is finally applied to the fuel injection valves 17. The system illustrated in FIG. 1 includes a status signal generator or an engine braking recognition and control circuit 18 which receives signals from the speed transducer 10 and from the throttle valve transducer 12 as well as a further engine temperature signal. The output of the recognition circuit 18 is applied to one input of the pulse correction circuit 15 as well as to a switch 19 which is opened during engine braking and interrupts the closed-loop λ-control during that time and switches over to direct forward control.

The condition of engine braking is defined by the simultaneous occurrence of a closed, or substantially closed, throttle valve and the occurrence of an engine speed exceeding a predetermined value. These simultaneous conditions will occur for example during downhill operation of the vehicle when the accelerator pedal is released. However, the general notion of engine braking or engine overrunning (negative torque operation) is broad enough to include any condition in which the vehicle decelerates solely due to a release of the accelerator pedal. The accelerator pedal may be released only partially, i.e., the throttle valve may not be fully closed, provided only that the engine speed is higher than the speed which would be obtained under steady state conditions in the normal horizontal operation of the vehicle at the particular accelerator position. For example, under these definitions, engine overrunning will be said to occur when the engine speed lies above a certain threshold for a relatively small load. Accordingly, the engine braking or engine overrunning recognition circuit must receive a load signal in addition to the engine speed signal. The load signal may be derived from any one of three sources:

1. A throttle valve position transducer, in particular a throttle valve switch indicating a fully closed throttle valve;

2. A threshold switch connected to the air flow rate meter which, for low air flow rate indicating low load, generates a signal which is combined with a high speed signal to indicate engine braking. The threshold switch may advantageously be a comparator connected to the air flow rate meter;

3. The load signal may be derived from an evaluation of the pulse duration of the pulses $t_p$ or the pulses $t_i$. Short fuel injection pulses would indicate a low load. If the length of the pulses exceeds a given value, and if, at the same time, the engine speed lies above a certain threshold, then engine overrunning is assumed and the fuel is reduced.

Figure 2A:
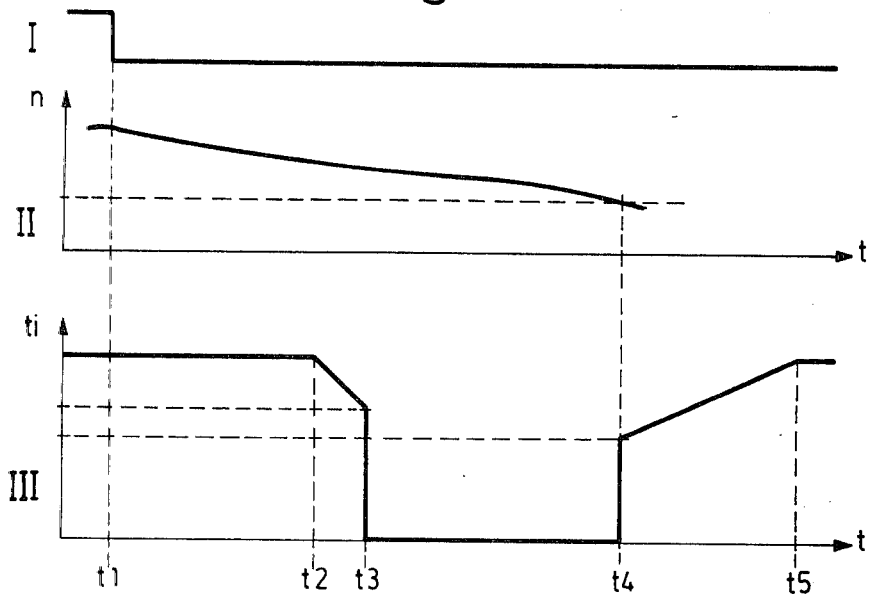
FIGS. 2*a* and 2*b* are timing diagrams illustrating the throttle valve position, the engine speed and the relative fuel quantity as a function of time according to the present invention.

The method according to the invention provides for a sequence of events as illustrated in FIG. 2. In the first application, illustrated in FIG. 2*a*, there are shown three curves, a first signal I related to the output of the throttle valve position switch, a second signal II which represents the output signal of an rpm transducer and a third signal III representing the normalized fuel quantity in terms of the control pulse duration $t_i$. In the simplest embodiment, the throttle valve position transducer 12 of FIG. 1 is a simple switch indicating when the throttle valve is closed. As seen in FIG. 2*a*, this switch is actuated at the time $t_1$, indicating a closure of the throttle valve. The curve II of FIG. 2*a* indicates that the engine speed decreases uniformly until it falls below a resupply threshold shown in dashed lines at a time $t_4$. The curve III which represents the injected fuel quantity is defined by several different regions. Up to the time $t_1$, the throttle valve is still open while the engine speed lies above the resupply threshold and the fuel injection pulses are determined solely by normal operational variables.

At the time $t_1$, the throttle valve switch indicates a closed throttle and the engine speed begins to decrease. According to the invention, and as illustrated in FIG. 2*a*, curve III, the length of the fuel injection control pulse is maintained at the normal value for some time so as to prevent the system to respond immediately to what may be spurious and erroneous signals, as well as to the normal speed and load changes occurring during gear shifting. However, if the engine braking conditions persist beyond a time $t_2$, the injected fuel quantity, i.e., the length of the fuel control pulses $t_i$, is gradually reduced to a value of approximately 0.85 of their normal value until, at a time $t_3$, the fuel supply is entirely shut off. The fuel shutoff is maintained until such time as the engine speed has dropped to below the resupply threshold indicated in dashed lines in the curve II and this cross-over is shown to occur at a time $t_4$. The resupply threshold speed is chosen to be somewhat greater than the normal engine idling speed so as to prevent a stalling of the engine when idle speed is reached. Accordingly, the fuel supply is reinstated at the time $t_4$ but initially only with a less than normal magnitude so as to prevent abrupt torque changes while insuring the smooth running of the engine. This reinstatement value advantageously lies at a value of approximately 0.8 of the normal value but may also occur at a substantially different value depending on the type of engine and the use to which the engine is put.

Beginning with the time $t_4$, the fuel supply is increased linearly until it reaches the normal value at a time $t_5$ at which time the fuel supply is again controlled on the basis of instantaneous prevailing engine states. Any change in the throttle valve position subsequent to the time $t_4$ does not affect the linear increase of the fuel supply until the normal supply is reattained.

The time interval between $t_4$ and $t_5$ is suitably chosen to correspond to the desired driver comfort, in particular with regard to the occurrence of abrupt changes in engine torque. The time interval between $t_4$ and $t_5$ also depends on the rapidity with which normal fuel injection control pulses can be supplied again.

Figure 2B:
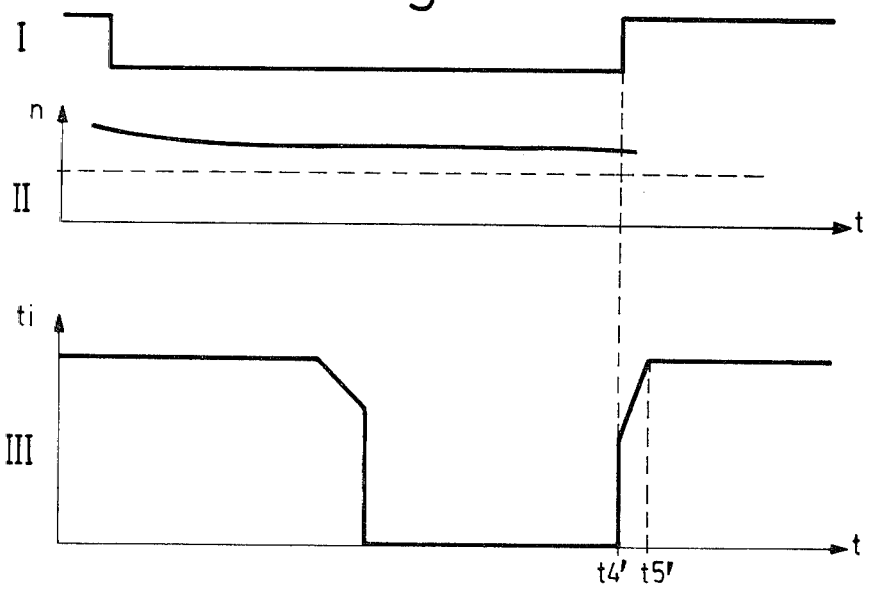

The diagram of FIG. 2*b* illustrates the case in which the engine overrunning condition is deliberately terminated by the vehicle operator in that he presses down the accelerator pedal, thereby opening the throttle valve at the time $t_4'$. Accordingly, the engine never decelerates to a speed below the resupply threshold line and the fuel supply is reinstated regardless of the prevailing engine speed. As seen in FIG. 2*b*, the throttle valve position signal (curve I) abruptly increases again at the time $t_4'$ and fuel supply also reoccurs at this time. In this case, the interval between $t_4'$ and $t_5'$ is made substantially smaller than in the example of FIG. 2*a* because, in this case, the driver has deliberately pressed the accelerator pedal, indicating his intention of accelerating the vehicle and thus would expect a somewhat abrupt increase cf the engine torque. Nevertheless, the resupply of fuel is not made instantaneous but takes place within a finite but reduced interval $t_5'-t_4'$ in consonance with acceptable driving comfort.

The fuel control curves III in diagrams 2*a* and 2*b* are subject to a number of variations. For example, the time interval between $t_1$ and $t_2$ may be of constant duration or may be made dependent on engine characteristics. In particular, this interval may be made dependent on an electronic transmission control. The interval $t_2-t_3$ may also be made dependent on operational variables as may be the functional dependence of the fuel reduction during this interval. In particular, the reduction may take place according to a parabolic function of time which brings the advantage that the reduction of the fuel quantity does not have any gradient jumps, thereby making any abrupt torque changes improbable.

Furthermore, the duration of the interval $t_4-t_5$ and the manner in which fuel is readmitted in that interval may also be selected on the basis of prevailing requirements.

The fuel quantity, i.e., the percentage of normal fuel quantity at which fuel supply is completely cut off at the time $t_3$, as well as the fuel quantity to which fuel is immediately resupplied at the time $t_4$, may both be made dependent on external variables.

Figure 3:
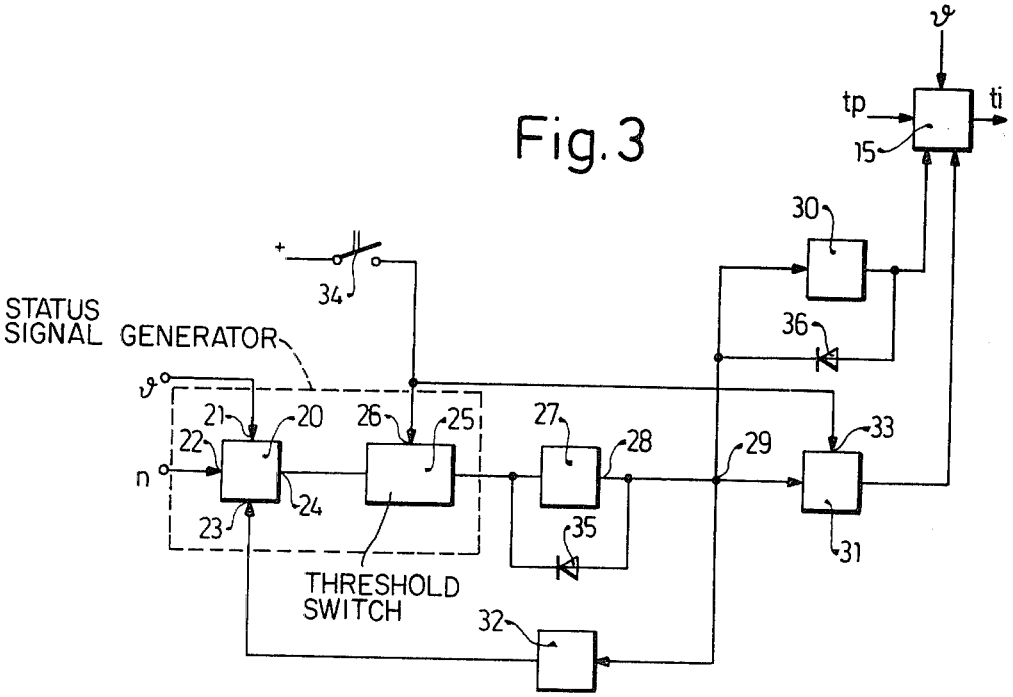
FIG. 3 is a block diagram illustrating the apparatus for fuel control during engine braking in greater detail.

An apparatus for carrying out the method illustrated in FIGS. 2*a* and 2*b* is shown in an overall schematic block diagram illustrated in FIG. 3.

The system illustrated in FIG. 3 includes a network consisting of a combination of resistors, capacitors and diodes (RCD network) having input contacts 21, 22, and 23 and an output 24. The output 24 goes to an input of a controllable threshold switch 25 having a control input 26. Connected behind the threshold switch 25 is a first timing circuit 27 for generating the time interval $t_1$–$t_2$ as shown in FIGS. *2a* and *2b*. The output 28 of the timing circuit 27 defines a junction point 29 to which are connected a second timing circuit 30, an integrating circuit 31 and a hysteresis stage 32. The integrator 31 has a secondary control input 33 connected to the control input 26 of the threshold switch 25; this common line carries a positive voltage when the throttle switch 34 is closed. The outputs from the timing circuit 30 and the integrator 31 are fed to respective inputs of the pulse correction circuit 15 which alters the basic fuel control pulses $t_p$ and delivers the final fuel control pulses $t_i$.

The pulse correction circuit 15 is a known circuit, for example as described in U.S. Pat. No. 3,483,851. The signals applied at the input of the RCD network 20 include a temperature signal applied at the input 21, an engine speed signal applied at the input 22 and a supplementary control signal which comes from the hysteresis stage 32 and is applied at the input 23. The function of the circuit illustrated in FIG. 3 will now be discussed with the aid of the illustrations of FIG. 2. In normal operation of the engine, i.e., when no engine braking takes place and the engine supplies positive torque to the vehicle, the correction circuit 15 receives the basic uncorrected fuel injection pulses of duration $t_p$. These pulses are processed in the correction circuit 15, for example on the basis of temperature, and are transformed into final valve-control pulses $t_i$ which are applied to subsequent electronic circuitry and finally cause the actuation of the fuel injection valves of the engine. In normal operation, the signals from the timing circuit 30 and the integrator 31 do not affect the conversion of the fuel control pulses.

When the throttle valve 34 is closed at the time $t_1$ and if, at the same time, the threshold switch 25 indicates an engine speed above the resupply threshold speed, the timing circuit 27 is triggered. At the time $t_2$, the timing circuit 27 generates an output signal which triggers the second timing circuit 30 and the integrating circuit 31. The latter begins to integrate and generates an output signal which linearly reduces the duration of the fuel injection pulses $t_i$ to correspond substantially to the curve shown in FIG. III between the times $t_2$ and $t_3$. When the time $t_3$ is reached, the timing circuit 30 switches back and blocks the output signal of the pulse correcting circuit 15, thereby providing for total fuel shutoff.

The integrating circuit 31 is suitably so constructed as to have upper and lower limiting values of 1.0 and 0.8 of the normal injected fuel quantity so that, at the time $t_4$, the injected fuel quantity immediately goes to 80 percent of the normal quantity and is then gradually increased to 100 percent of the normal quantity. The reinstatement of fuel supply takes place on the basis of engine speed as sensed by the threshold switch 25 which applies an appropriate signal to the junction point 29. In order to permit the immediate application of the signal to the junction 29, a suitably connected diode 35 shunts the timing circuit 27. In a similar manner, a diode 36 shunts the second timing circuit 30 so that the pulse correction circuit 15 is able to function normally immediately after the resupply threshold is reached.

The pulse correction circuit 15 is basically a known circuit which must however include means for blocking its output signal on the receipt of the appropriate information at the time $t_3$, i.e., after the expiration of the time interval generated by the second timing circuit 30 and for returning to a normal operation when the engine slows down below the reinstatement threshold. Furthermore, the correcting circuit 15 must include means for receiving the signal from the integrating circuit 31 for continuous adjustment of the length of the fuel control pulses during the intervals $t_2$–$t_3$ and $t_4$–$t_5$. These dependencies can be obtained in the following way:

1. The output of the integrator 31 is connected via a resistor to change the $t_i$ pulse in the correcting circuit 15 multiplicatively.
2. The signal from the integrator 31 changes the corrected control pulse additively.
3. The signal from the integrator 31 controls the output pulse both additively and multiplicatively.

The signal from the throttle valve position switch is also applied to an input 33 of the integrator, thereby permitting the resupply of fuel when the throttle valve is deliberately opened by the driver.

The hysteresis stage 32 serves to generate a different threshold valve in the RCD network 20 when a signal occurs at the junction point 29. This has the effect of changing the response threshold of the threshold switch 25, thereby generating a cutoff threshold and a reinstatement threshold for the engine speed, the cutoff threshold being at a higher speed than the reinstatement threshold. The purpose of separating these two thresholds is to permit fuel cutoff only at engine speeds lying above a predetermined threshold so as to prevent an oscillation between fuel supply and fuel cutoff which would cause the engine to operate erratically.

The two speed thresholds may also be changed on the basis of temperature via the control input 21 of the RCD network 20. It may be suitable and necessary to change the thresholds for fuel cutoff and fuel reinstatement on the basis of other events. For example, a normal change of the engine timing or the increase of the air flow rate, for example due to the operation of air conditioning units, may cause an increase in the engine speed. In order to prevent erratic behavior of the engine braking recognition circuit, it is possible to shift the speed thresholds at which the circuit becomes effective. For example, the switchover of the engine timing which results in the increase of the speed may also be used to cause automatic increases of the thresholds of the engine braking recognition circuit.

The circuit illustrated in FIG. 3 may be varied by eliminating the timing circuit 30 and by inserting a threshold switch behind the integrator circuit 31, and providing for the threshold switch to generate an output signal when the integrator signal reaches 85 percent of the normal fuel quantity. The threshold switch signal may then be used to directly engage the correcting circuit 15. In addition to, and independently of, engaging the pulse correction circuit 15 during engine braking, the signal occurring at the junction point 29 or at the output of the timing circuit 30 may also be used to switch the closed-loop λ-control of the engine to a suitable forward control based on an average value of the air factor λ. The λ-control system may also be held at the value which it had attained just prior to closure of the throttle valve.

Figure 4:
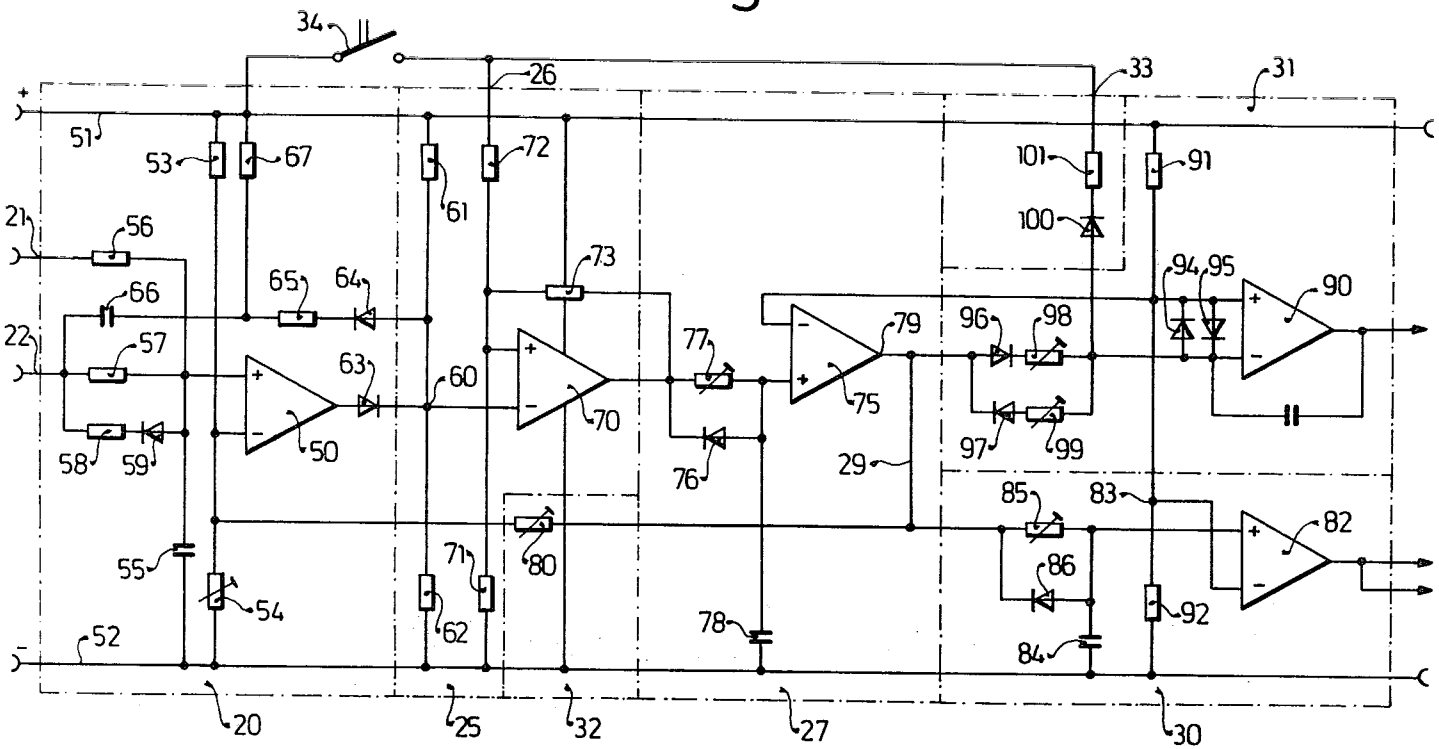
FIG. 4 represents a detailed circuit diagram of the apparatus shown in blocks in FIG. 3.

A detailed embodiment of the apparatus illustrated in FIG. 3 is shown in the circuit diagram of FIG. 4. The blocks of FIG. 3 are indicated by dashed borders. The circuit of FIG. 4 contains the following sub-circuits. The RCD network 20 includes an amplifier 50 whose negative input is connected to the tap of a voltage divider consisting of resistors 53 and 54, respectively connected to a positive supply line 51 and a negative supply line 52. The non-inverting input of the amplifier 50 is connected through a capacitor 55 to the negative line 52 and through a resistor 56 to the input contacts 21, permitting a temperature-based control. The positive input of the amplifier 50 is further connected via the parallel disposition of a resistor 57 and the series connection of a resistor 58 and a diode 59 to the engine speed input contact 22. The output of the RCD network 20 is a junction point 60 which represents the voltage divider tap of two resistors 61 and 62 connected between the operational supply lines. The junction 60 is connected to the output of the amplifier 50 via a diode 63, and a diode 64 of opposite polarity is connected through a resistor 65 and a capacitor 66 to the engine speed input 22 of the network 20. Finally, a resistor 67 is connected between the junction of the capacitor 66 and the resistor 65 on the one hand and the positive supply line 51 on the other hand.

The threshold switch 25 includes an amplifier 70 whose inverting input is connected to the junction point 60 and whose non-inverting input is connected through a resistor 71 with the negative supply line 52 as well as via a resistor 72 with the control input 26. The control input 26 is connected to one contact of the throttle position switch 34 whose other contact is connected to the positive supply line of the circuit. When the throttle valve switch 34 is closed, the positive voltage is thus applied to the control input 26. A resistor 73 supplies feedback for the amplifier 70.

The second timing circuit 27 also includes an amplifier 75 whose non-inverting input is connected to the output of the amplifier 70 of the threshold switch 25 via the parallel connection of a diode 76 and a resistor 77. This input is further connected to the negative supply line 52 via a capacitor 78.

The junction point 29 is formed by the output 79 of the amplifier 75 in the circuit of FIG. 4. The output 79 is connected via a hysteresis stage 32, formed by a resistor 80, with the inverting input of the amplifier 50 within the RCD network 20.

Also connected to the output 79 of the amplifier 75 is a second timing circuit 30 and an integrating circuit 31. The timing circuit 30 includes an amplifier 82 whose negative input leads to a circuit point 83 and whose positive input is connected via a capacitor 84 to the negative supply line 52 as well as to the output 79 of the amplifier 75 via the parallel connection of a resistor 85 and a diode 86.

The integrating circuit 31 includes an amplifier 90 with capacitive feedback whose non-inverting input is connected to the aforementioned circuit point 83. This point constitutes the junction of two resistors 91 and 92, respectively connected between the voltage supply lines 51 and 52, and the point 83 is also connected with the inverting input of the amplifier 75 of the first timing circuit 27. Two oppositely connected diodes 94 and 95 lie between the two inputs of the amplifier 90. The integrating amplifier 90 receives its input signal from the output 79 of the amplifier 75 via the parallel connection of two diode-resistor pairs. These pairs consist of the two diodes 96 and 97 and the two resistors 98 and 99, respectively. Finally, the inverting input of the amplifier 90 is connected to the integrator control input 31 via the series connection of a diode 100 and a resistor 101 and the input 31 is coupled to one contact of the throttle valve position switch 34 to which the input of the amplifier 70 in the threshold switch 25 is also connected.

The above-described circuit functions in the following manner:

The input signal present at the engine speed input 22 of the RCD network 20 is a train of pulses in synchronism with the ignition timing, whose frequency is thus proportional to the engine speed. At low engine speeds, the period between pulses is large and at high engine speeds the period is small. When the input 22 is at a high voltage, the capacitor 55 is charged via the resistor 57. When the engine speed is low, the capacitor 55 is charged to a high enough voltage to permit the amplifier 50 to generate a positive output signal. At the same time, a negative pulse passes through the diode 64 and the capacitor 66 to the junction point 60 of the threshold switch 25 which operates as a bistable threshold switch, i.e., a flip-flop. Depending on the magnitude of the engine speed, the "setting pulse" received via the diode 64 or the "resetting pulse" via the diode 63 will predominate. When the throttle valve is closed, i.e., when the voltage at the positive input of the amplifier 70 is high, the output of this amplifier 70 is switched to a high or low potential. A positive signal at the output of the amplifier 70 is delayed by the timing circuit 27 due to the presence of the resistor 77 and the capacitor 78 and appears at the output 79 of the amplifier 75 only after an interval, whereas a negative-going edge of the signal from the output of the amplifier 70 is passed directly to the output 79 via the diode 76. The timing circuit 27 thus operates only for positive-going pulse edges.

Similar events occur at the second timing circuit 20 which also delays only positive-going edges whereas negative-going edges are immediately applied to the amplifier 82 via the diode 86.

The constant of integration used by the integrating circuit 31 may be adjusted for both directions of integration by means of the adjustable resistors 98 and 99 in connection with the diodes 96 and 97. An additional change of the integration constant may be obtained via the control input 33, the resistor 101, as well as the other diode 100 from the throttle valve switch 34.

The output signal of the integrator 31 engages either the multiplicative or the additive corrective section in the pulse correction circuit 15 in both the increasing or decreasing directions. When the integrator turns off, the timing circuit 30 completely suppresses the fuel control pulses $t_i$ and, at the same time, the λ-feedback control is switched over to a particular forward control value.

When the throttle valve is reopened or the engine speed falls below the reinstatement threshold speed, the diodes 76 and 86 immediately release the delivery of fuel injection control pulses. When the engine speed falls below the threshold, the manner in which the integrator integrates upwardly can be set by the adjustable resistor 99, whereas its behavior during an opening of the throttle valve and thus an opening of the throttle switch 34 may be adjusted by selecting the value of the resistor 101 and the diode 100 and occurs with a smaller time constant. In order to provide different cutoff and reinstatement speeds for the fuel supply and thus to prevent undesirable ambiguities, the RCD network is provided with hysteresis by means of a resistor 80 in the hysteresis circuit 32. The hysteresis provides switching stability and prevents rapid and undesirable changes from fuel supply to fuel cutoff which would result in abrupt torque changes and might have deleterious effect on the exhaust gas quality.

The onset and termination of the integration process may be determined by means of the resistor 85 and another resistor, not shown, connected between the integrator output and the pulse correction circuit 15. The decision with respect to the exact value of the reduced fuel supply at which fuel supply is completely shut off and the decision at what fraction of normal fuel supply the fuel is to be reinstated depends on the type of engine used, the purpose to which the engine is put and a variety of other circumstances. In the particular example shown, the cutoff percentage is 85 percent of normal fuel supply and the reinstatement percentage is 80 percent.

In extreme cases, it may be desirable to resupply the entire normal fuel quantity after shutoff. The time function according to which fuel is resupplied from complete shutoff to the normal value may be of any suitable shape, for example it may be a straight line, an exponential curve or a parabola.

The foregoing relates to merely a preferred exemplary embodiment of the invention, it being understood that other embodiments and variants thereof are possible within the spirit and scope of the invention.

What is claimed and desired to be secured by Letters Patent of the United States is:

1. A method for controlling the fuel supply for an internal combustion engine during engine braking, comprising the steps of:

reducing the amount of fuel fed to the engine according to a first function of time at the onset of engine braking, wherein said first function of time decreases monotonically from an initial value equal to the quantity of fuel admitted at the onset of braking until the first function of time is approximately a predetermined percentage of the initial value whereupon the first function of time decreases abruptly to zero; and increasing the amount of fuel fed to the engine according to a second function of time at the termination of engine braking, wherein said second function of time has an initial value which is a predetermined percentage of the nominal fuel quantity required by the engine for normal operation.

2. A method according to claim 1, wherein said first and second functions of time are dependent on at least one operational variable of the engine.

3. A method according to claim 2, wherein the predetermined percentage of said first function of time is approximately 80 to 90 percent, and wherein the predetermined percentage of said second function of time is approximately 80 percent.

4. An apparatus for controlling the fuel supply for an internal combustion engine during engine braking, said engine including a fuel injection system with a fuel control pulse correcting circuit, said apparatus comprising:

a status signal generator for generating status signals which define the condition of engine braking; and a function generator means for receiving said status signals and for controlling the output of said pulse correcting circuit to decrease monotonically the amount of fuel supplied to the engine according to a first function of time at the onset of engine braking from an initial value equal to the quantity of fuel admitted at the onset of braking until the first function of time is approximately a predetermined percentage of the initial value whereupon the first function of time decreases abruptly to zero; and to increase the amount of fuel fed to the engine according to a second function of time at the termination of engine braking, wherein said second function of time has an initial value which is a predetermined percentage of the nominal fuel quantity required by the engine for normal operation.

5. An apparatus according to claim 4, wherein said function generator includes at least one integrating circuit (31).

6. An apparatus according to claim 4, further comprising a first timing circuit (27) connected ahead of said function generator for delaying the actuation of said function generator for a preselected period of time subsequent to the onset of engine braking.

7. An apparatus according to claim 4, wherein said function generator includes provisions for external control.

8. An apparatus according to claim 7, wherein said function generator is controllable from the output of said status signal generator and wherein said apparatus further comprises an engine speed transducer and a throttle valve position transducer for generating input signals applied to the input of said status signal generator.

9. An apparatus according to claim 7, wherein said function generator is controllable from the output of said status signal generator and wherein said apparatus further comprises an engine speed transducer and an air flow rate meter for generating input signals applied to the input of said status signal generator.

10. An apparatus according to claim 7, including means for applying to said status signal generator engine speed signals and fuel injection control pulses.

11. An apparatus according to claim 4, wherein said status signal generator includes a resistor-capacitor-diode network feeding including input contacts for accepting signals related to engine speed, engine load and temperature, and a threshold switch fed by said resistor-capacitor-diode network.

12. An apparatus according to claim 4, wherein said status signal generator includes a resistor-capacitor-diode network feeding including input contacts for accepting signals related to engine speed, engine load and ignition timing, and a threshold switch fed by said resistor-capacitor-diode network.

13. An apparatus according to claim 8, wherein said status signal generator includes circuit means for imparting hysteresis to the engine speed threshold level.

14. An apparatus according to claim 11, wherein said fuel injection system includes an air factor control loop which can be disengaged by the output signal from said status signal generator.

15. An apparatus according to claim 4, further including a timing circuit, wherein said fuel injection system includes an air factor control loop which can be disengaged by the output signal from said timing circuit.

16. An apparatus according to claim 11, wherein said fuel injection system includes an air factor control loop which can be disengaged by the output signal from said function generator (31).

17. An apparatus according to claim 4, wherein the output signal of said function generator engages said fuel control pulse correcting circuit in additive manner.

18. An apparatus according to claim 4, wherein the output signal of said function generator engages said fuel control pulse correcting circuit in multiplicative manner.

19. An apparatus according to claim 4, wherein the output signal of said function generator engages said fuel control pulse correcting circuit in additive and multiplicative manner.

* * * * *